US008220182B2

(12) United States Patent
Righetto

(10) Patent No.: US 8,220,182 B2
(45) Date of Patent: Jul. 17, 2012

(54) FOOTWEAR SOLE AND FOOTWEAR HAVING SAID SOLE

(75) Inventor: Lucio Righetto, Stra (IT)

(73) Assignee: TN & Co. di Lucio Righetto, Stra (VE) (IT)

( * ) Notice: Subject to any disclaimer, the term of this patent is extended or adjusted under 35 U.S.C. 154(b) by 1122 days.

(21) Appl. No.: 11/994,423

(22) PCT Filed: Dec. 7, 2005

(86) PCT No.: PCT/EP2005/056557

§ 371 (c)(1),
(2), (4) Date: Feb. 2, 2008

(87) PCT Pub. No.: WO2006/061397

PCT Pub. Date: Jun. 15, 2006

(65) Prior Publication Data

US 2008/0313924 A1 Dec. 25, 2008

(30) Foreign Application Priority Data

Dec. 7, 2004 (IT) ..... SV2004A0044

(51) Int. Cl.
*A43B 7/08* (2006.01)
*A43B 13/20* (2006.01)

(52) U.S. Cl. ..... 36/28; 36/3 B; 36/29; 36/141

(58) Field of Classification Search ..... 36/28, 35 R, 36/25 R, 32 R, 59 C
See application file for complete search history.

(56) References Cited

U.S. PATENT DOCUMENTS

| | | | | |
|---|---|---|---|---|
| 4,918,838 | A * | 4/1990 | Chang | 36/28 |
| 5,682,690 | A | 11/1997 | Chang et al. | |
| 5,768,802 | A | 6/1998 | Bramani et al. | |
| 5,822,886 | A * | 10/1998 | Luthi et al. | 36/28 |
| 6,082,024 | A | 7/2000 | Del Biondi et al. | |
| 6,209,226 | B1 * | 4/2001 | Squadroni | 36/3 B |
| 7,200,955 | B2 * | 4/2007 | Foxen | 36/25 R |
| 7,288,648 | B2 * | 10/2007 | Hamilton et al. | 540/554 |
| 2004/0068892 | A1 * | 4/2004 | Wang | 36/28 |

FOREIGN PATENT DOCUMENTS

| | | |
|---|---|---|
| FR | 767 998 | 7/1934 |
| JP | 06070801 | 3/1994 |

* cited by examiner

*Primary Examiner* — Jila Mohandesi
(74) *Attorney, Agent, or Firm* — Themis Law

(57) ABSTRACT

The invention relates to a footwear sole with massaging effect comprising an external sole configured for resting on the ground and at least an insole interposed between said external sole and the user's foot. In one embodiment, the footwear has one or more vertically movable pliable areas peripherally connected to the remaining portion of the sole by bridges of elastically pliable material, which project from the outer sole and are moved towards the foot during walking. Such pliable areas are provided with an extension passing through a slot of said insole and having at least a foot contacting end portion composed of a soft or elastically pliable material. In another embodiment, the inner vamp lining the outer vamp and the outer vamp are free to slide one with respect to the other.

30 Claims, 12 Drawing Sheets

FOOTWEAR SOLE AND FOOTWEAR HAVING SAID SOLE

FIELD OF THE INVENTION

The present invention relates to a footwear sole with massaging effect and to footwear produced therewith.

BACKGROUND OF THE INVENTION

Footwear soles with massaging effects are known and widely used, however they have several drawbacks. In prior art soles, the foot massage carried out with the stress discharged by the foot on the ground when walking is partially retransferred to the foot at preferred areas by using inserts mounted in the sole. Prior art inserts are often composed of materials with different elasticity with respect to the sole material and are inserted in the sole. A solution according to prior art, for example, provides areas with different elasticity inside the sole by putting inserts that are embedded in the sole material, that is, in the footwear sole at least an insert is incorporated having elasticity and density different with respect to the remaining part of the sole, and so when walking, areas made of different materials and composing the footwear sole react in a different way, that is they retransfer to the foot the stressing exerted in differentiated manner among areas with different elasticity, or density, substantially producing a kind of massage to the foot.

Alternatively, according to prior art, elastic or spring inserts have been provided still inside the sole.

However, these solutions have some drawbacks mainly due to the fact that the foot massage areas are not confined in the selected areas, but often a very large foot area is concerned, causing to be massaged even areas that were not intended to be massaged.

In order to obtain a massage of the foot in prior art solutions, massage inserts are positioned between the sole and the insole, or as an alternative, only on the sole. Thus there is provided a message that however, due to the presence of the insole, is substantially distributed on all the user foot sole. Usually there is provided an insole between the massage insert and the foot in order to increase comfort, since prior art massage inserts are made from materials that do not adapt to the foot shape and, according to prior art, the insert is positioned under the insole, particularly on the sole, in order to allow the user's foot to rest on the soft insole, that in turn rests upon the massage insert. Thus in prior art soles a massage of the foot can be obtained without reducing comfort, however causing the massage to be distributed on large areas of the foot sole, making the massage less specific and less directed than desired. In an alternative according to prior art, it is possible to localize the massage area, but this involves reducing comfort for the user by removing the insole.

A further drawback of the prior art is that inserts with different elasticity are often inserted inside the sole, that is embedded in the sole material, which involves high manufacturing costs. For example, in a mass production of a considerable number of soles, the inserts have to be inserted directly inside the sole material, involving considerable difficulties and high manufacturing cost and time.

Generally, in prior art different types of inserts have been produced for foot massage, such as for example springs or point-like inserts coming out from the sole towards the foot or the like. However, a main problem is that said inserts provide a massage to areas that are not confined, and thus even to areas where the massage is not desired, with the further drawback that the massage in the areas of interest is reduced.

Moreover, in prior art soles, inserts are often homogeneously composed of the same material that has the same elasticity. This causes the foot to be often in contact with a material that has very good elasticity, but with a poor comfort for the foot, which is in contact with a more rigid region than the one necessary for the massage. This drawback is due to the fact that the insert must have a sufficient rigidity in order not to completely give way under the body weight when walking, and often the rigidity necessary for walking is greater than the one necessary for comfort. Moreover, when compressing an elastic material, the resistance to compression and so rigidity increases with increasing compression. Therefore, the greater the compression is, the greater the hardness of the compressed material is.

SUMMARY OF THE INVENTION

The present invention relates to a footwear sole with massaging effect comprising an external sole for resting on the ground and at least an inner sole, the so called insole, interposed between said external sole and the user's foot, characterized in that the external sole has one or more vertically movable pliable areas peripherally connected to the remaining portion of the sole by means of bridges of elastically pliable material, such as bellows or the like, and which region or regions project out the ground resting portion of the external sole, operating as shock absorbers of walking pressure on the foot; said pliable regions being provided with an extension in the foot direction passing through a slot of said insole and having at least an end portion for directly contacting the foot composed of soft or elastically pliable material.

Preferably, said material is composed of a synthetic gel member. Synthetic gel has such elastic compressibility features that when compressed, the synthetic gel member does not become un-compressible or does not get hard as in all known elastomeric materials. Due to this construction, it is possible to adjust the pressure stress on the foot, and at the same time a damping effect is obtained even in the greatest compression condition during various walking steps described above.

Moreover, in the footwear sole according to the present invention the pliable areas are preferably two pliable areas or compression buttons made one in the area corresponding to the foot heel and the other one in the area corresponding to the foot metatarsus. Thus the drawbacks of prior art soles are easily overcome.

More particularly, the two forces acting at the heel and the point where the foot sole bends, that is the pressure of the foot towards the ground and the ground thrust in opposition, assist and cause a stress in the above points for properly stimulating the foot when walking.

According to a further manufacturing characteristic, the extension at the area corresponding to the foot heel, related to the corresponding compression button, is made as a tubular structure that is provided in peripheral contact with the pliable area of the external sole, and has on the top a foot contacting end portion made like a plug of said tubular structure.

The plug of the tubular structure has a surface in contact with the foot made by means of a set of projections of rounded shape placed side by side that are preferably made of an elastically pliable and/or soft material, such as a synthetic gel.

Thus the sole according to the present invention has one or more areas for foot massaging, particularly at the foot heel and metatarsus area, which produce a strong localized massage in the area of interest.

When walking, the sole portion projecting towards the outside is pressed and vertically moved by means of bellows and in turn it operates the extension that moves towards the user's foot. Thus the foot massaging effect is very localized, since the only portion of the external sole that is operated for the massage is the one projecting and coinciding with the areas where the massage is desired.

The presence of a tubular structure at the heel provides for a type of massage that is most concentrated and localized in the central area of the heel, that is where it is most necessary, avoiding the massage in the peripheral areas, where the massage is not desired. Moreover the tubular structure increases the compressibility range, within which the compressible material keeps a certain pliability without reaching the condition of being almost uncompressible as in prior art devices.

According to a further embodiment, the tubular structure is preferably made by two rolls, one external roll and an inner roll, both in contact with the pliable area of the external sole and with the contact end portion, further improving the heel massage.

The extension of the pliable area provided at the area corresponding to the foot metatarsus is made of a plurality of individual extensions of cylindrical shape extending from the elastically pliable area to the user's foot, these extensions of cylindrical shape having a free end of rounded shape faced towards the foot and being completely or partly made of an elastically pliable and/or soft material, such as a synthetic gel.

Even projections of said foot contacting end portion made as a plug of said tubular structure are composed of an elastically pliable and/or soft material, such as a synthetic gel.

Thus the drawbacks relative to prior art according to which the insert or the extension has such a rigidity to compromise the comfort are actually avoided.

Moreover, prior art drawbacks related to having massage areas that are not limited or localized are avoided, because the massage inserts according to the present invention are such that a good massage and an optimal comfort of the foot are contemporaneously guaranteed.

According to a further variant embodiment, a further cleaning insole may be provided interposed between the user's foot and the remaining portion of the sole, however the thickness of said cleaning insole is such that it never compromises the localized massage action of the foot. The cleaning insole has a small thickness, since it is provided only for hygienic purposes and not for structural purposes. In this case, said cleaning insole has no slots for the contact of said extensions with the user's foot, and it can be composed of a non elastic material.

According to a variant embodiment, it is also possible to provide for extensions that are not integral with the external sole. In this case, the extensions preferably have a T-shaped side section, or like a mushroom, where the T top portion is faced towards the user's foot, and it has an overall convex surface, in order to optimize the massage of the foot areas. In this variant embodiment said external sole has a housing for engaging said T-shaped extensions, making for an easier assembly during production.

A further aim of the present invention is to provide footwear comprising at least a sole, an outer vamp, optionally an inner vamp (lining), and an insole, which is provided with high comfort and generates very soft footwear.

In footwear of the prior art, the outer vamp and the inner vamp are glued together substantially along the entire length. The so coupled inner vamp and outer vamp are generally glued and sewn with one perimetral tongue between the insole and the sole. The coupling of the inner vamp and of the outer vamp substantially along the entire surface involves the manufacturing of a laminar member with layers that are integral one with respect to the other, causing a considerable rigidity of the finished vamp of the footwear. That is in particularly the case at the forward area that is bent during walking. Therefore, in footwear of the prior art there is a vamp that has a considerable strength but that on the other hand provides for footwear that is uncomfortable, especially when the footwear is to be worn for quite a long time, due to the poor flexibility of inner vamp and outer vamp assembly rigidly laminated one with the other. The two vamp layers that are rigidly coupled one with the other do not allow a relevant sliding one with respect to the other, actually making the inner vamp and outer vamp assembly less capable of being deformed and less flexible, and thus causing the footwear to be more rigid.

Therefore, according to a further aspect of the present invention in order, to overcome drawbacks of footwear of the prior art, the inner vamp is peripherally attached to the inner perimetral edge or at least to part thereof by sewing, gluing and/or sealing, while the outer vamp is overlapped to the inner vamp and it is attached only to the insole or between insole and sole and/or along the upper perimetral edge of the inner vamp defining the opening for wearing the footwear.

Therefore, the so obtained footwear structure is a kind of double-shell composed of the insole and inner vamp and outer vamp, the two shells being engaged one with the other along the size of the insole and the sole and along perimetral edges of the inner vamp and outer vamp defining the opening for wearing the footwear.

According to an advantageous embodiment, the inner vamp and the insole are sewn one with the other at least along a part of the entire size of contact edges.

Particularly along the edges fastening the perimetral edge of the insole, the inner vamp has a continuous or discontinuous peripheral tongue extending for at least part or for the entire length of the perimetral edge of the insole, which tongue is intended to overlap the lower side of the insole so to be interposed between the insole and the sole when the sole is mounted on the insole.

The outer vamp at least along the peripheral edge for coupling to the insole and/or the sole or being interposed between the insole and the sole has a continuous or discontinuous peripheral tongue extending for at least a part of the size of the perimetral edge of the insole and/or for the entire length of said perimetral edge of the insole, which tongue is intended to be fastened to the sole and/or in a position overlapped to the lower side of the insole and/or between sole and insole.

An advantageous embodiment provides for the inner vamp to be sewn to the insole only for the forward part of the vamp and of the insole and the outer vamp to be simply overlapped on the inner vamp only for said part of the inner vamp sewn to the insole, while the remaining part of inner vamp and outer vamp, that is corresponding to the rear part or the heel of the vamp, is conventionally made by gluing the two vamps along substantially their entire size, perimetral tongues of the two vamps in the forward part and in the rear one being fastened between the insole and the sole.

That causes the footwear to be very soft in the forward part where the footwear is subjected to greater amount of flexing during walking. On the contrary, the rear part that is not subjected to the walking action is more rigid, in this part the two vamps being glued together along the entire size and so causing the footwear to be more rigid at the area where the deformation stress is lower and where the vamp strength is required. A sliding between the inner vamp and the outer vamp is therefore limited only to the area where it is really necessary, that is only where the footwear bends to a greater extent, that is in the forward area of the footwear, in the area surrounding the metatarsus.

The invention is particularly advantageous for footwear for women having an elongate or point-like forward part.

Fastening of the peripheral edges of the outer vamp to the inner vamp delimiting the opening for wearing the footwear occurs in a conventional way by gluing, sealing and/or sewing or by combinations of these methods.

Further variant embodiments and further improvements aim at improving the massage effect or such effect in combination with a greater resistance and strength of the footwear, even with regard to the type of footwear and the use thereof.

BRIEF DESCRIPTION OF THE DRAWINGS

These and other features and advantages of the present invention will appear more clearly from the following description of some embodiments illustrated in the accompanying drawings, in which.

DETAILED DESCRIPTION OF THE INVENTION

Figure 1:
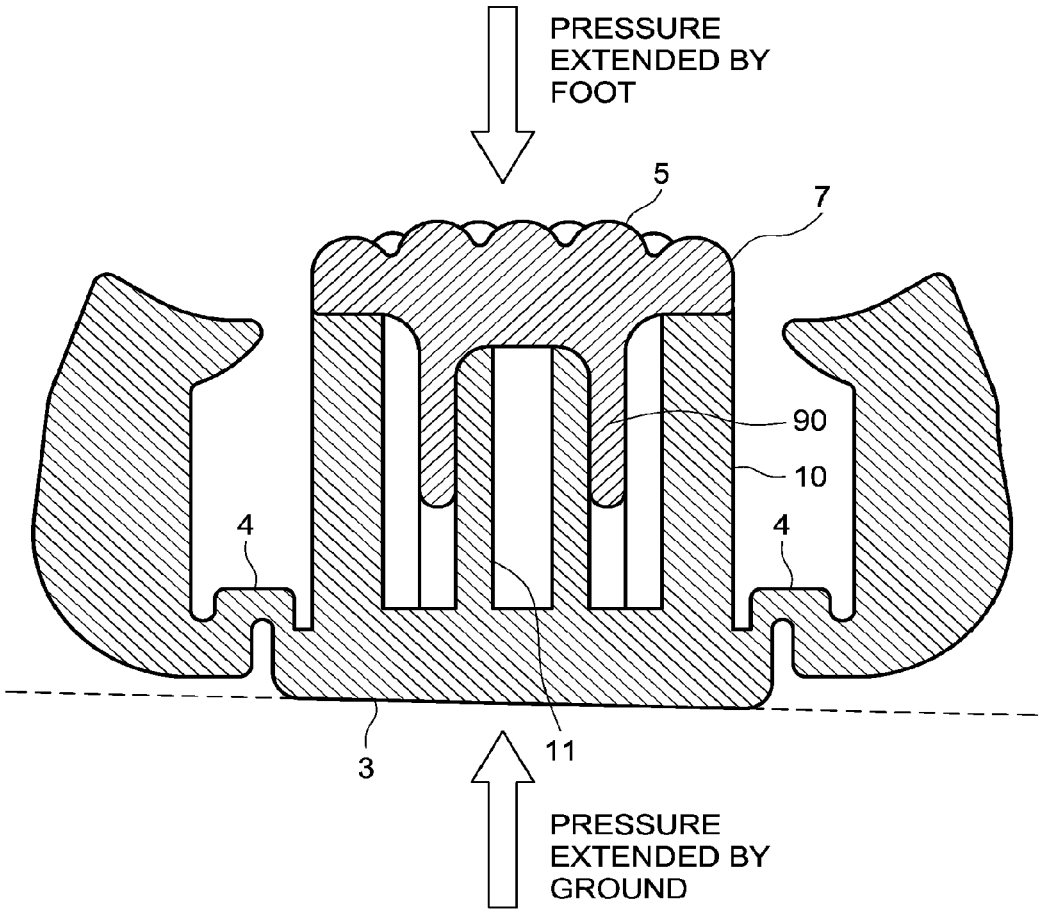
FIG. 1 is a section of the sole area according to the present invention corresponding to the heel.

Turning first to FIGS. 1-9, there is shown a first embodiment of the present invention where the extensions 5 are integral with the external sole 1 according to the present invention. FIG. 1 shows the section of the heel area of the external sole 1 showing the extension 5 made according to the preferred embodiment of two tubular members one inside the other. FIG. 1 also shows the bridges 4 made of elastically pliable material, such as bellows or the like that surrounds the pliable area 3 and connect it to the external sole 1. Said pliable area projects from the ground resting side of the external sole, and thus it is moved towards the foot acting as shock absorber between walking action and foot pressure when it comes in contact with the ground. According to the present embodiment, said tubular structure is preferably made by means of two hollow rolls, an external roll 10 and an inner roll 11, both in contact with the pliable area or compression bottom 3 of the external sole and with the foot contact end portion 7 made like a plug of said tubular structure.

Figure 2:
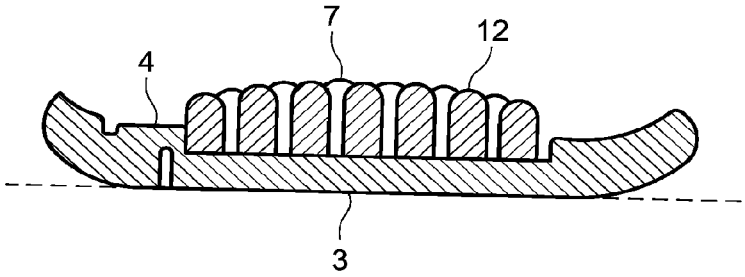
FIG. 2 is a section of the sole area according to the present invention corresponding to metatarsus.

Particularly the foot contact end portion 7 has a surface in contact with the foot made by means of a set of projections of rounded shape placed side by side as shown in FIGS. 1 and 2.

FIG. 2 shows the sole portion according to the present invention corresponding to metatarsus. In this sole portion, a further pliable area 3 is provided, where a plurality of individual extensions 12 of cylindrical shape are associated extending from the elastically pliable area to the user foot. Said individual extensions 12 are placed side by side and eventually adherent or in contact one with the other and have a free preferably rounded-shaped end, faced towards the foot, in order to make comfortable the foot massage action.

Figure 3:
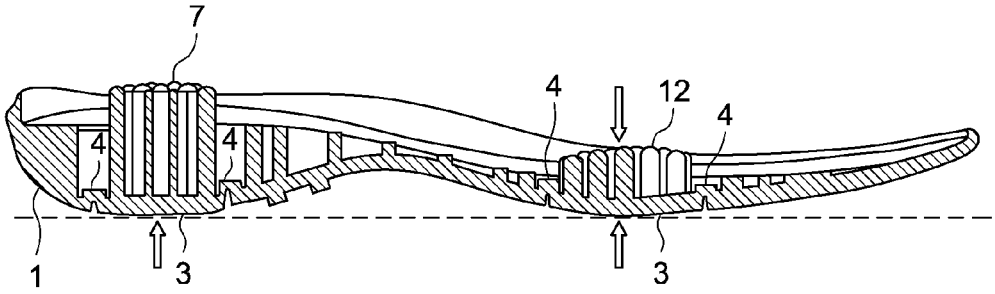
FIG. 3 is a longitudinal section of the sole according to the present invention.

FIG. 3 shows the two areas and the two extensions placed on the heel and on the metatarsus according to a side section.

Figure 4:
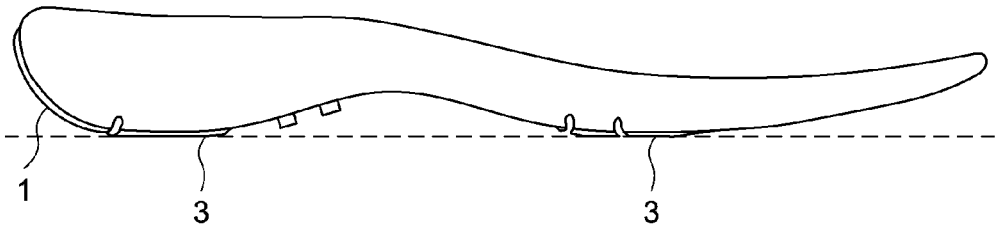
FIG. 4 is a side view of a sole comprising the two pressure areas (and with a merely representative and approximate drawing, so a variable one) according to the present invention.
Figure 5:
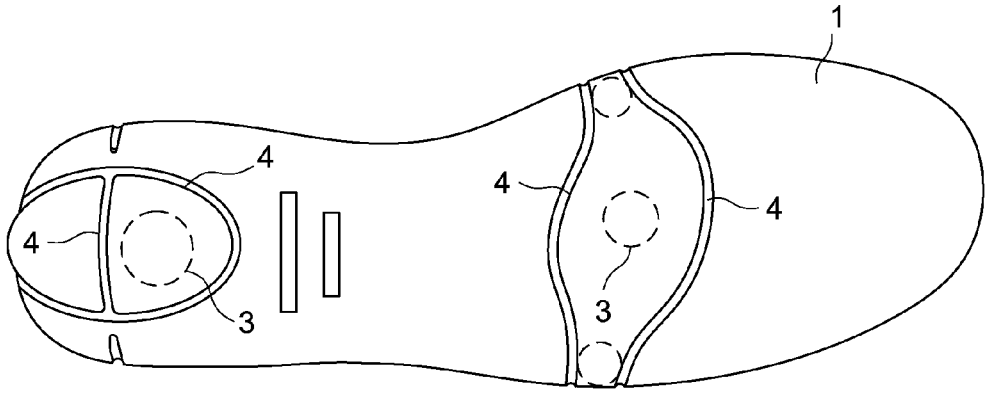
FIG. 5 is a bottom and plant view of a sole according to the present invention.

FIGS. 4 and 5 show the two pliable areas 3, and here it can be seen how these project outwardly from the profile of the external sole 1, coming first in contact with the ground while walking and so exerting the compression action on the metatarsus and heel areas, in a very specific and directed way.

Figure 6:
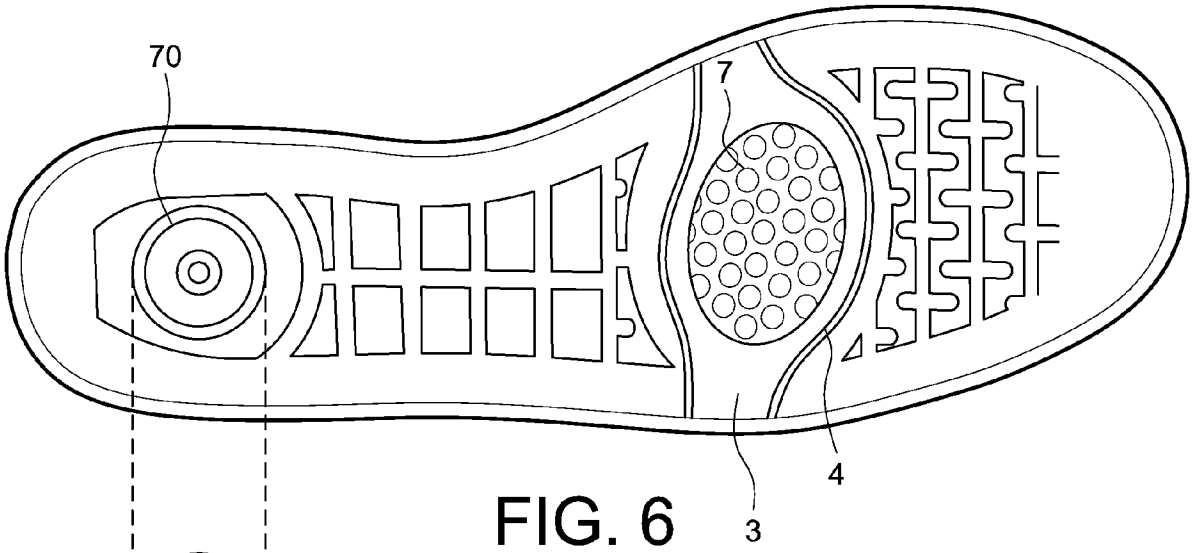
FIG. 6 is a top and plant view of a sole according to the present invention.
Figure 7:
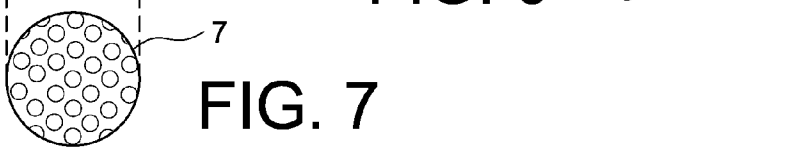
FIG. 7 is a top view of the foot contacting end portion made like a plug of said tubular structure.
Figure 8:
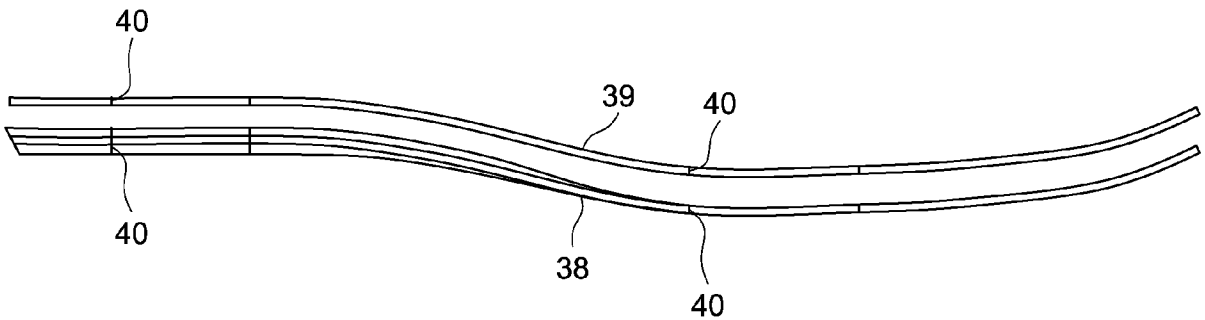
FIG. 8 is an insole and a cleaning insole showing slots for the passage of the extensions according to the present invention.

FIGS. 6 and 7 show a top view of the two extensions, and the particular realization thereof, having a foot contacting end portion 7, preferably composed of synthetic gel or other pliable materials, that is made of a series of rounded forms placed side by side one with respect to the other, in order to guarantee a comfortable massage of the foot.

The surface of the two extensions 5 faced towards the foot may be alternatively made of a single synthetic material layer having a plurality of substantially hemispheric surfaces placed side by side or of various substantially hemispheric surfaces made of synthetic material individually applied on end parts of roll 10, 11.

Figure 9A:
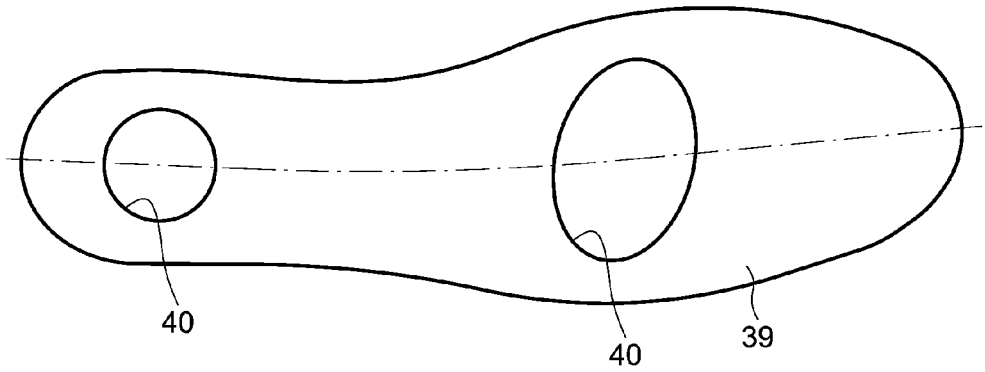
FIG. 9*a* is a plant view of a cleaning insole having slots for the passage of extensions according to the present invention
Figure 9:
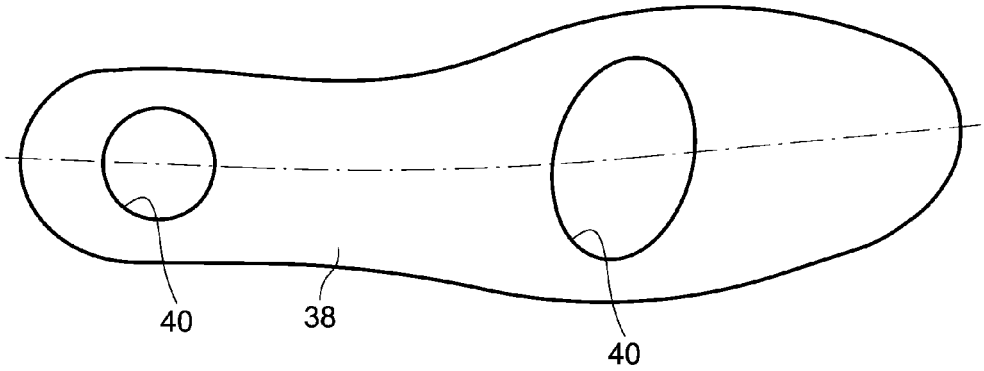
FIG. 9 is a plant view of a insole and of a cleaning insole showing slots for the passage of the extensions according the present invention.
Figure 10:
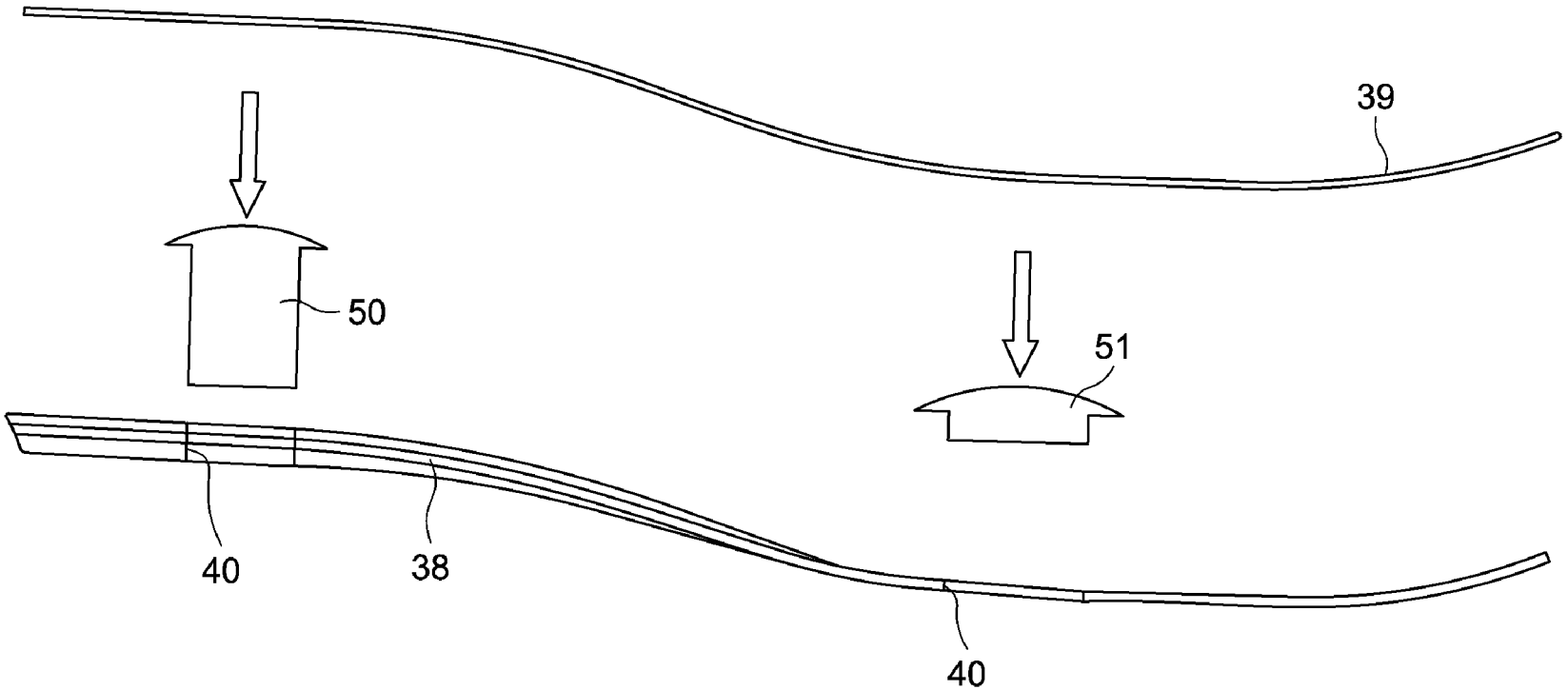
FIG. 10 is a side view of a section plane of a cleaning insole without slots, an insole and two extensions according to a variant embodiment of the present invention.
Figure 11:
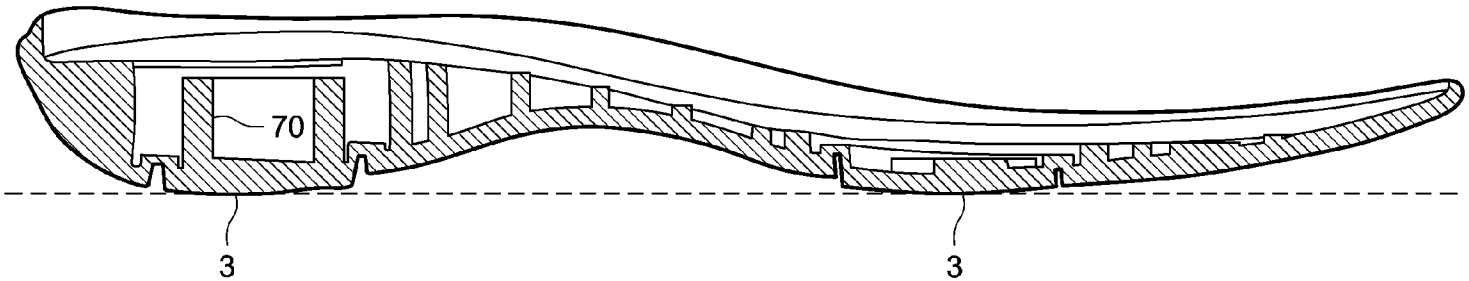
FIG. 11 is a side section of an external sole according to a variant embodiment of the present invention.
Figure 11A:
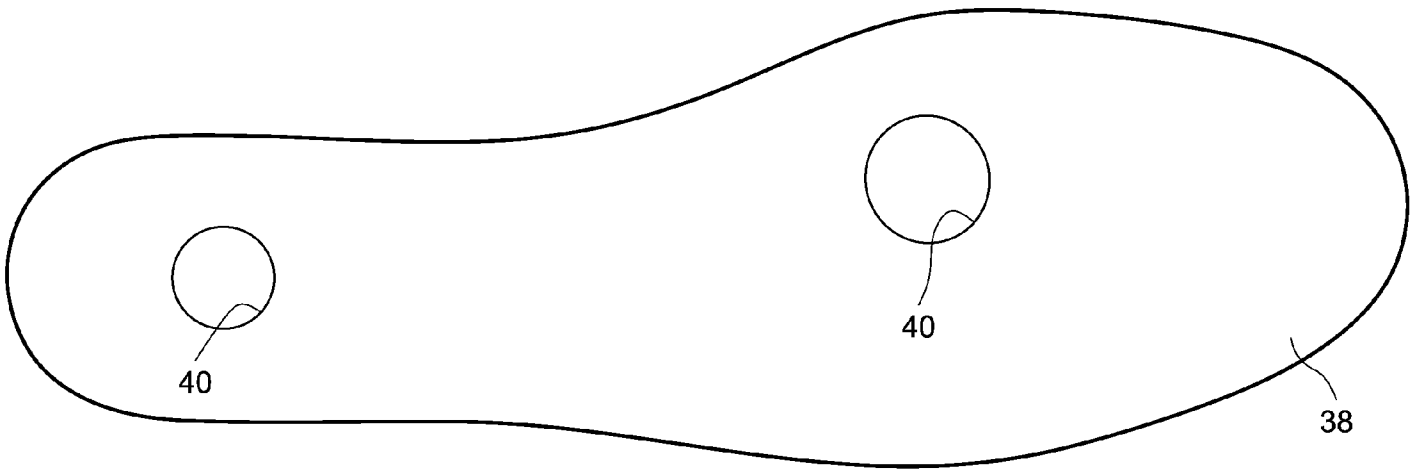
FIG. 11*a* is a plant view of an external sole according to an alternative embodiment of the present invention
Figure 12:
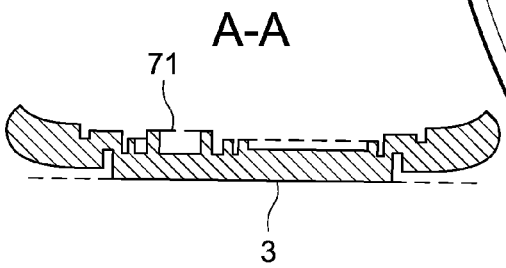
FIG. 12 is a section of the sole area according to a variant embodiment of the present invention corresponding to metatarsus.
Figure 13:
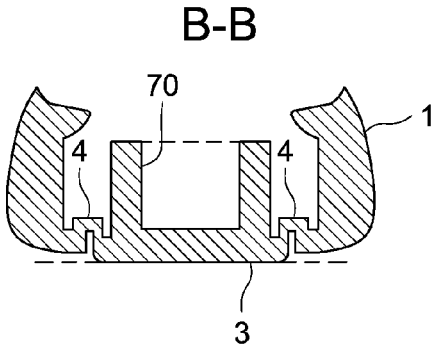
FIG. 13 is a section of the sole area according to an alternative embodiment of the present invention corresponding to the heel.
Figure 14:
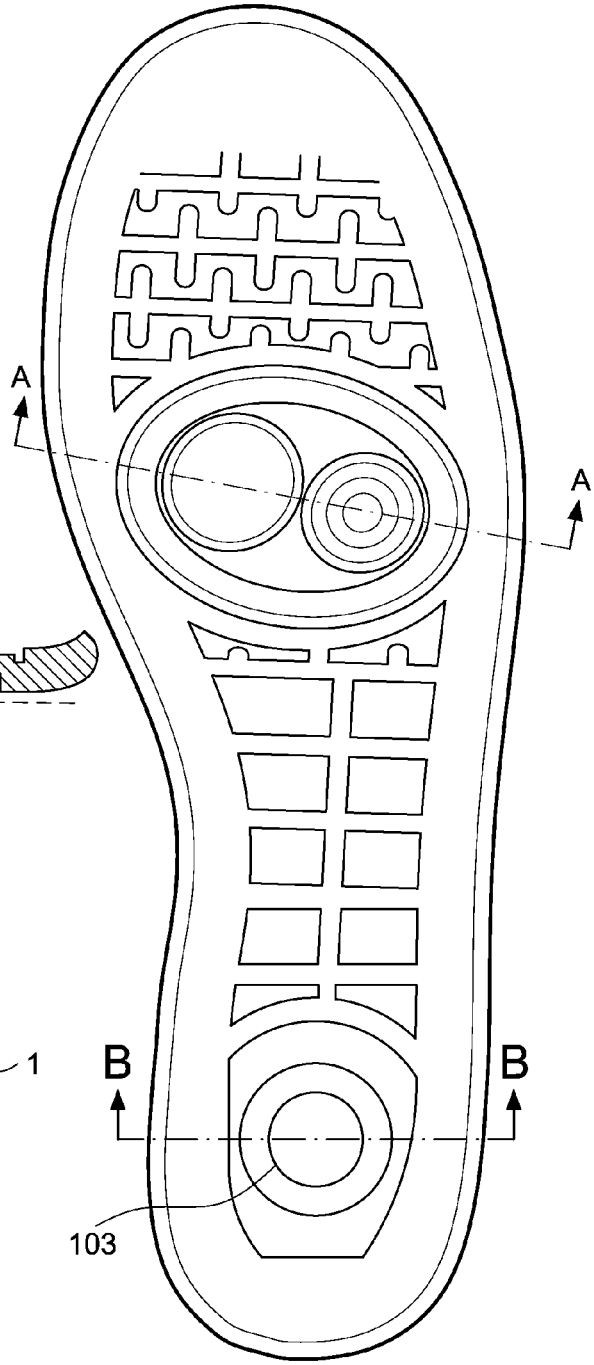
FIG. 14 is bottom and plant view of a sole according to an alternative embodiment of the present invention.

FIG. 9 shows slots that are provided on the insole and for the cleaning insole, said slots have a shape substantially corresponding to the extension shape. Such slots advantageously help in localizing the massage in a very definite and preferred area of the foot, since the slot made on the insole allows the extension to act directly on the foot, concentrating the massage action in the chosen area. It is also possible to make corresponding slots on the cleaning insole, in order to further localize the massage. Due to the particular embodiment of massage extensions, having a head area, made of gel, that is the one for resting the foot, there is no lack of comfort, with the massage insert directly contacting the foot.

In FIGS. 10 to 14 there is shown an alternative preferred embodiment of the present invention, wherein extensions are not integral with the sole, but are made as two inserts 50, 51 engaging with the sole 1 having a T-shaped section, where the T top portion is faced towards the user foot and it has an overall convex surface.

In this case said external sole has one or more housings 70, 71 for the engagement of said T-shaped extensions 50, 51.

Even in this case it is possible to have a slot 40 on the insole 38 and to have a cleaning insole 39 without slots.

Figure 18:
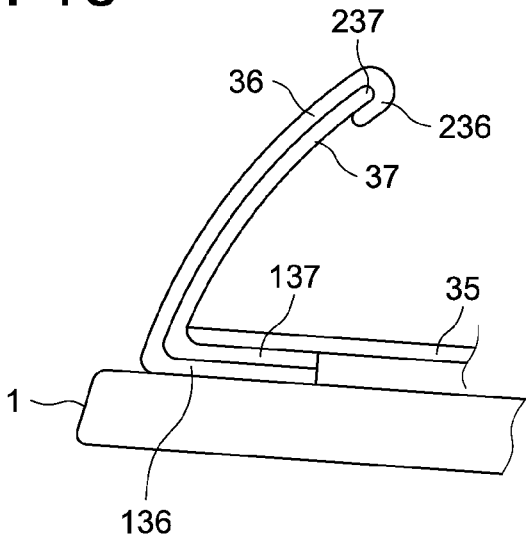
FIG. 18 is a variant embodiment of footwear comprising a sewing between outer vamp and inner vamp.
Figure 19:
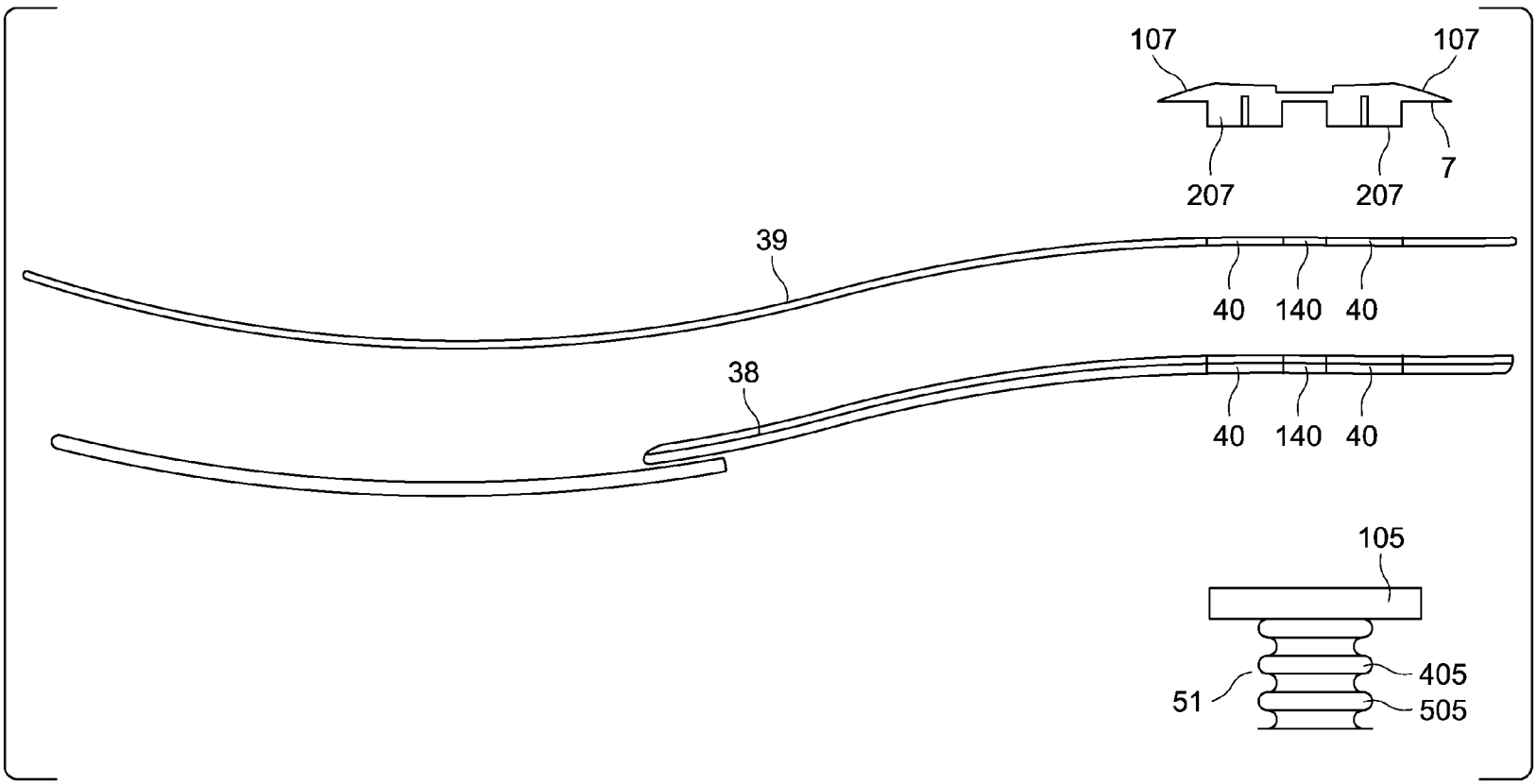
FIG. 19 is partial sectional side view of the insole part and of the intermediate extension part as well as of foot contacting end of a sole according to the present invention.
Figure 20:
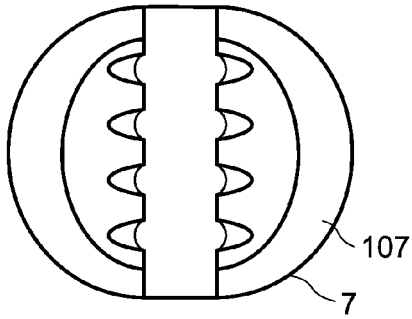
FIG. 20 is a plant view from above of the enlarged head 107 of the foot contacting end.
Figure 21:
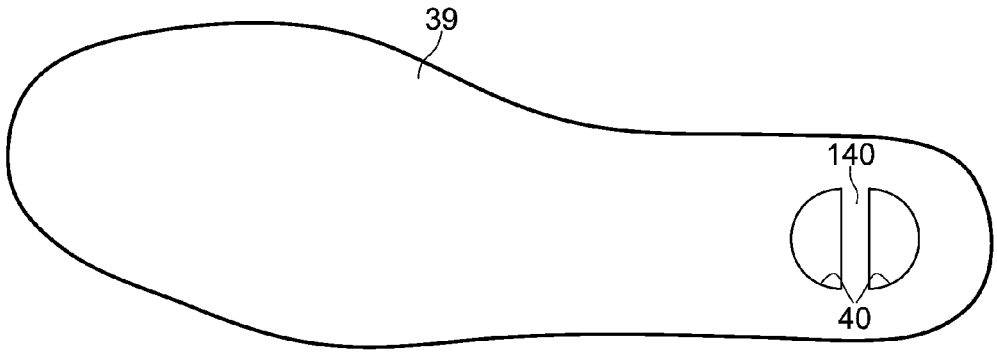
FIG. 21 is a plant view of the cleaning insole.
Figure 22:
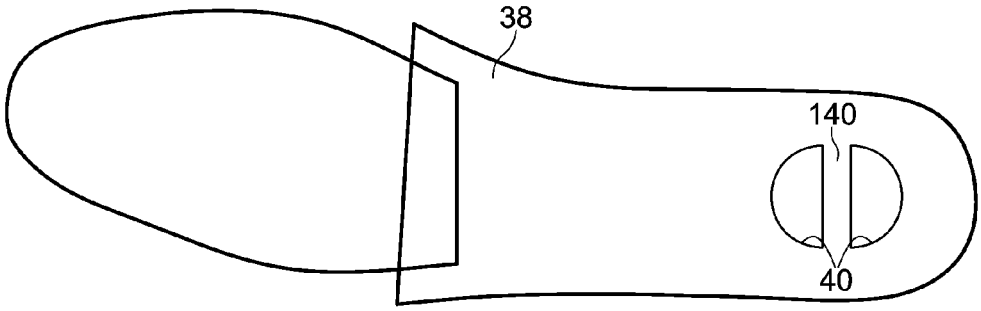
FIG. 22 is a plant view of the insole.
Figure 23:
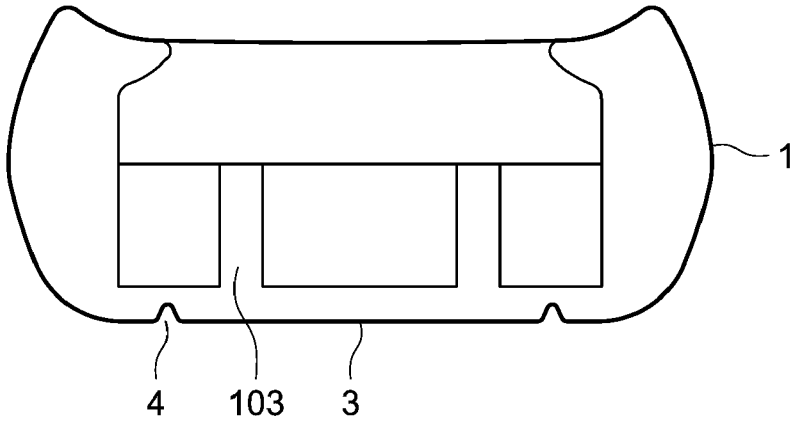
FIGS. 23 to 25 are various section views of a sole part according to the present invention.
Figure 24:
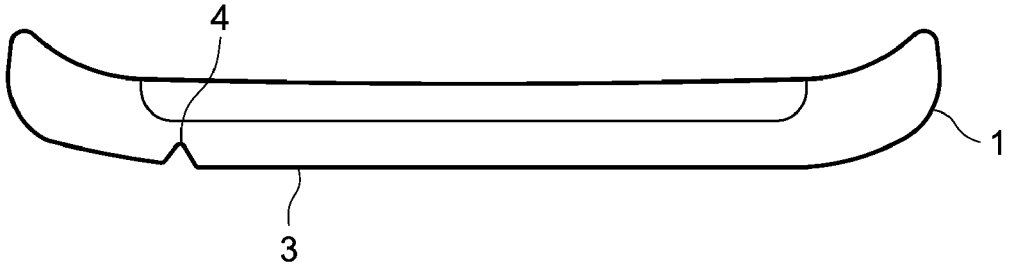
Figure 25:
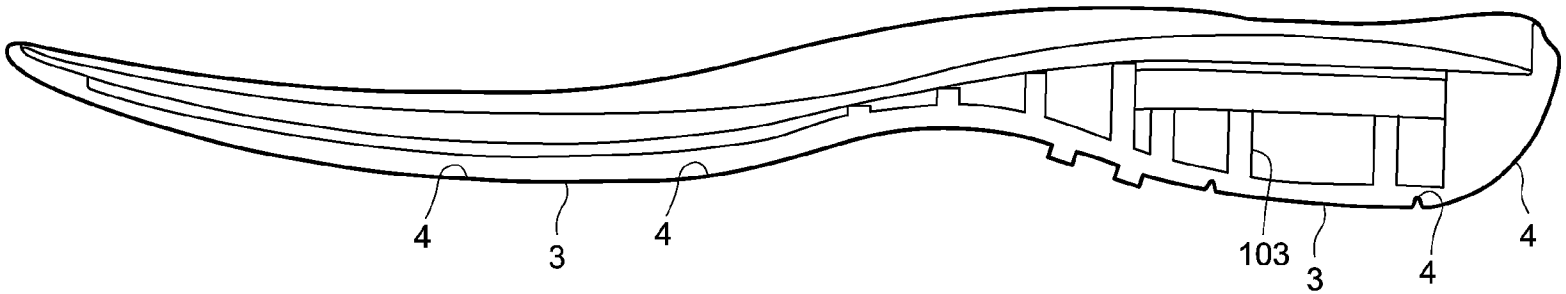
Figure 26:
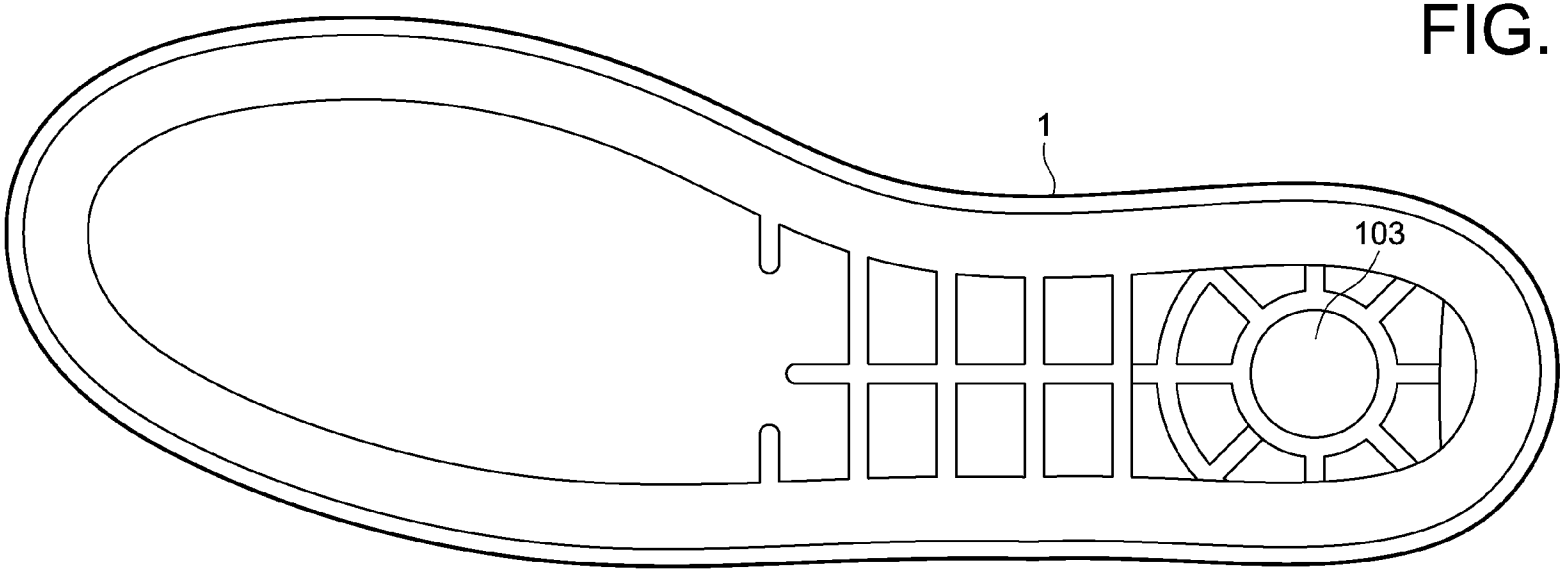
FIG. 26 is a plant view from above of the sole of FIGS. 23 to 25.

FIG. 18 shows the inner vamp 37, the outer vamp 36 and the insole 35 in respective mounting positions.

Figure 15:
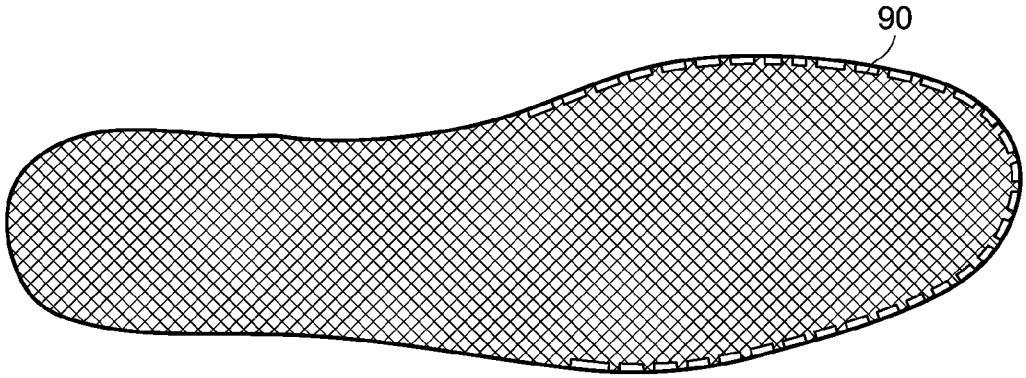
FIG. 15 is a plant view of footwear comprising a sewing between outer vamp and inner vamp.
Figure 16:
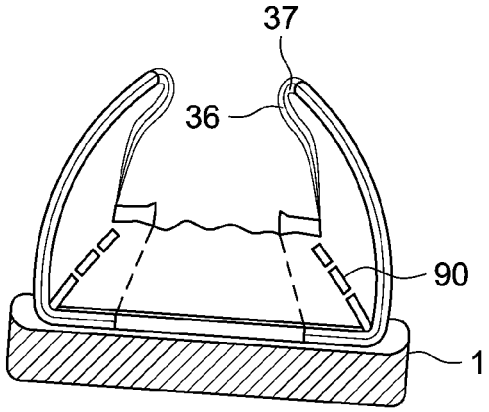
FIG. 16 is a section plane of footwear comprising a sewing between outer vamp and inner vamp.
Figure 17:
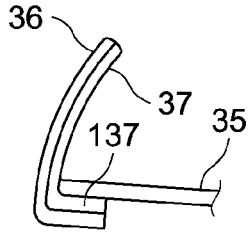
FIG. 17 is a section view of footwear comprising a sewing between outer vamp and inner vamp.

In FIGS. 15 and 16 there is shown the area wherein the seam between inner vamp 37 and insole 35 is preferably made, and they are sewn together by means of a seam 90 extending at least partially in the area corresponding to the forward area of the footwear. Obviously such seam may extend for the entire length of the peripheral edge for mutual coupling of the inner vamp 37 with the insole 35.

Advantageously, along at least part of or for the entire peripheral edge coupling to the insole 35 the inner vamp 37 has a continuous or discontinuous tongue 137 overlapping the lower side of the insole 35. At least partially or fully there is provided an inner footwear composed of the inner vamp 37 and the insole by means of the seam 90. Insole 35 and inner vamp 37 are generally made of a quite thin and soft material and constitute layers in contact with the foot.

Such inner footwear or inner footwear shell is externally covered by the outer vamp 36 and the sole 1 composing the outer part of the footwear. According to the present invention, the outer vamp 36 externally covers the inner vamp 37 and it is attached to the sole 1 together with the inner vamp 37 and the insole 35. Advantageously even the outer vamp 36 has a perimetral tongue 136 for fastening the sole 1 and insole 35 intended to be interposed between the insole and particularly between the tongue 137 of the inner vamp and the faced side of the sole 1. The fastening may occur by means of gluing and/or sealing and/or sewing or combinations of these methods.

Moreover the two vamps are connected one with the other along perimetral edges delimiting the wearing opening indicated by 237 and 236. Fastening along edges 236 and 237 occurs in a conventional way and in FIG. 18 along said perimetral edge 236 the outer vamp 36 has a tongue overlapping the edge 237 of the inner vamp 37. A person skilled in the art will recognize that any type or method may be used for fastening together said two vamps 36 and 37 along said edges 236 and 237 delimiting the opening for wearing the footwear.

The above manufacturing of the footwear, wherein the outer vamp is not engaged with the inner vamp but along overlapping tongues 136 and 137, that is along edges fastening the sole 1 and along edges 237 and 236 delimiting the wearing opening allows the two vamps 36 and 37 to freely slide one on the other causing the footwear to be softer during flexing.

Referring to a variant embodiment, and when the footwear type provides a vamp extending the entire perimetral size of the sole or insole, for example in a loafer or the like, it is possible to provide the inner vamp 37 being fastened by its perimetral edge to the insole and to the outer vamp 36 as well as to the sole only for the forward part of the footwear, as shown in FIG. 16. Particularly the forward half of the footwear provides for the inner vamp to be fastened directly to the insole by means of a seam 90 extending only along the perimetral edge of said forward insole half. Similarly as described above in this forward half the outer vamp 36 will be fastened only to the sole and/or insole by the tongue overlapping the lower side of the insole as well as obviously along the edge delimiting the wearing opening and relevant to said forward footwear part. For the remaining rear portion of the footwear, the outer vamp 36 can be glued to the inner vamp for its entire size both in a continuous way and by areas or points according to conventional techniques, making a vamp with two material layers rigidly coupled one to the other. In this lower half even tongues 136 and 137 overlapping the lower side of the insole are coupled one with the other and the two vamps together with these tongues 136 and 137 are fastened to the sole and/or between the insole and the sole. Therefore, the disengaged double-shell vamp is provided only for the forward part of the footwear, while for the rear part the two shells are rigidly coupled one with the other.

By providing the seam only at the forward part of the footwear allows to reduce the sliding action relevant to the two vamps 36 and 37 is reduced only to the area where it is really necessary, that is only where the footwear bends to a greater extent, therefore, to the forward area of the footwear, that is the area surrounding the metatarsus. On the contrary the rear part of the footwear has a less soft and flexible vamp but it is stronger and better fit for keeping its shape.

It is to be noted that the outer vamp and the inner vamp, and the insole and the sole, may be coupled one with the other even only by a finishing seam of along peripheral edges, in order to manufacture footwear wherein the fastening is carried out without gluing.

It is also possible to provide intermediate layers applied one over the other in a way similar to the one provided between the inner vamp and the outer vamp, and composed of at least one or more layers made of waterproof and breathable material and/or padding material.

The above footwear arrangement enables various variants such as, for example, providing the finishing seam between peripheral contact edges of the inner vamp and the insole even only partially along the edges, or alternatively having sewing areas alternated with gluing areas, in order to allow flexibility only where it is necessary, that is for example in areas surrounding the metatarsus of the foot and/or where the greatest flexion of footwear during walking is provided.

Variant embodiments are also suggested by the aesthetic shape and by the footwear type for example a more or less short or open footwear and a more or less high or closed one or a more or less long one.

It is to be noted that allowing the relative sliding of inner vamp and outer vamp reduces the forming of folds or wrinkles or bands at the upper forward area of vamp that can be often seen in conventional footwear and that is caused by the greater rigidity of the combination of the inner vamp with the outer vamp.

FIGS. 19 to 26 show a variant embodiment regarding the massaging effect of a sole according to the present invention.

In FIGS. 19 to 25 like reference numbers are used for like parts or parts having the same task.

In this variant embodiment, contrary to what has been described and shown with reference to FIGS. 1 to 14, the T-section extension 5 or 50 is composed of two parts, one of which is an intermediate extension part 5' and a foot contacting end 7. The intermediate extension 5' has an appendage 405 for coupling in an upper glass- or cup-shaped protrusion 103 of the pliable area 3 of the sole. The coupling engagement may occur in various manners, by means of release engagement means or the like or by elastic forcing means as shown. More particularly, as shown in the figures, the intermediate extension 5' has an appendage 405 that is shaped such to have a plurality of coaxial enlargements 505 alternated by narrowings, that is a sectional profile made of opposing sinusoidal lines along opposite edges. Thus the coupling appendage 405 has annular bands made of elastically pliable material alternated by annular narrowings, so by providing said annular bands with a diameter greater than the space of the glass-shaped protrusion 103 to a certain extent, it is possible to fasten the intermediate extension 5' to the pliable area 3 of the sole by interference fit.

As an alternative, intermediate extension 5' may be made to slide in the glass-shaped member 103, for example. By providing anti-withdrawing cooperating stop teeth between the appendage 405 of the extension intermediate member 5' and the glass-shaped member 103 and by providing an elastic coupling between the bottom of said glass-shaped member 103 and the intermediate extension 5'.

According to a further variant not shown, the extension intermediate member may be also glued, sealed or integrally-made or firmly fastened in another way known in the art to the pliable area 3 of the sole.

On the side of the insole, the extension intermediate member 5' integrally or separately extends by a foot contacting member 7 extending beyond the insole 38 and/or also beyond the finishing layer 39 through a passage slot 40. The contact head 107 of the foot contacting end 7 may extend substantially at the level with said insole or finishing layer 38, 39 or may project outside the surface of these parts to contact the foot, facing towards the foot.

The shown foot contacting end 7 is intended to rest simply on the head side of the extension intermediate member 5' faced towards it. As an alternative, it is possible for said foot contacting end 7 to firmly or movably engage the intermediate extension 5' by chemical/physical adhesion or by mechanical release or coupling.

The shown embodiment provides the foot contacting end 7 to be simply rested on the end head 105 of the intermediate extension 5'. Particularly, the foot contacting end 7 has an enlarged head 107 whose size is greater than the size of opening or openings 40 in the insole 38 and/or in the finishing layer 39 thereof and from which head at least a protrusion 207 extends to contact the head 105 of the intermediate extension 5' through openings 40 in the insole and/or in the finishing layer 39 or in the insole 38.

According to an advantageous embodiment, the foot contacting end 7 has means for engaging in the insole 38 and/or in the finishing layer 39. Particularly such means may be composed of radial enlargements of the protrusion or protrusions 207 engaging the edge of the slot or slots 40 in the insole 38 and/or in the finishing layer 39 on the side faced towards the sole 1. There can be provided other means, such as, for example, gluing or release fastening or chemical/physical adhesion.

Still according to a further feature, the insole and/or the finishing layer 38, 39 have at least two or more slots 40 separated one with respect to the other each one of said slots 40 being provided with a coinciding engagement protrusion 207. That prevents the end 7 from translating in a direction parallel to the insole 38 and/or to the finishing layer 39.

This feature is shown in FIGS. 19 to 22, which depicts a slot divided in two slots 40 by a transverse diametric material bridge 140. The two protrusions 207 of the foot contacting end 7 are made with a section having a shape corresponding to the plan profile of the two slots 40 and are spaced apart to an extent corresponding to the plan size of the material bridge 140.

It is to be noted that an alternative manufacturing is also possible wherein the protrusions 207 are not integral with the foot contacting end 7, but are composed of upper extensions of the head 105 of the intermediate extension 5'. As a further variant it is also possible for one or more protrusions 207 to be integrally manufactured with the foot contacting end 7 and for one or more additional protrusions 207 not coinciding with the former to be manufactured as extensions of the extension intermediate member 5.

With reference to the shown embodiment, the intermediate extension 5' has a head 105 having a plan size greater than the size of slot or slots 40 in the insole 38 and/or in the finishing layer 39, which head abuts at least against a part of the perimetral edge or edges delimiting the slot or slots 40.

Still according to a further variant the glass-shaped protrusion 103 of the pliable area may be provided with an open annular transverse section, in the peripheral skirt wall there being provided an axial slot, while said glass-shaped protrusion is radially fastened to the appendage 405 of the extension 5 or 50 or of the intermediate extension 5' by means of a ring (not shown in details) that is outwardly axially forced on said perimetral skirt wall of said protrusion 103.

Still another alternative may provide for the glass-shaped protrusion 103 to be made of a rim composed of wall axial members arranged at predetermined distances one with respect to the other along an ideal perimetral closed line for example a circular line instead of a perimetral skirt surface.

As regards the term "chemical/physical adhesion," it is to be noted that when possible various parts may be manufactured joined together, for example by an overmolding process according to various techniques known in the art of in plastic and/or natural and/or synthetic rubber materials.

It is also to be noted that even if various shown embodiments have different features, some of them can be provided in combination even though such feature combinations among the various embodiments are not expressly shown and described in details. Thus for example features regarding the embodiment of FIGS. 19 to 26 can be provided in any sub-combinations with one or more of specific features of various embodiments shown in FIGS. 1 to 18.

What is claimed is:

1. A footwear sole with massaging effect comprising:

an external sole;

an insole interposed between the external sole and a user's foot; and a cleaning insole facing the user's foot, wherein the external sole comprises one or more pliable areas extending from the external sole in the direction of the foot, wherein the one or more pliable areas are peripherally connected to the external sole by bridges of pliable material, wherein the one or more pliable areas move towards the foot when the one or more pliable areas come in contact with a ground during the user's walking, wherein an extension passing through a slot in the insole and the cleaning sole extends from the one or more pliable areas, wherein the extension includes a pliable foot contacting end portion protruding from the cleaning insole, and wherein the extension and the foot contacting end portion are movably coupled one inside the other, and wherein the extension is disposed within one of the one or more pliable areas.

2. The sole according to claim 1, wherein the one or more pliable areas comprise outer sole parts that are elastically and movably coupled together in a direction perpendicular or transverse to the sole, and wherein the one or more pliable areas on a side of the sole resting on the ground do not outwardly project towards the ground beyond a nominal surface connecting sole portions bordering the one or more pliable areas.

3. The sole according to claim 1, wherein the foot contacting end portion comprises an elastomeric material having such a compressibility that at a maximum compression condition between the foot and the sole, said end portion has a residual elastic compressibility.

4. The sole according to claim 1, wherein said foot contacting end portion is substantially made of a gel.

5. The sole according to claim 1, wherein the one or more pliable areas are disposed one in the area corresponding to a foot heel and the other one in the area corresponding to the foot metatarsus.

6. The sole according to claim 1, wherein the one or more pliable areas outwardly project from the external sole towards the ground beyond a nominal surface connecting sole portions bordering with the one or more pliable areas, whereby when the external sole rests on the ground and the footwear is not worn, only the one or more pliable areas contact the ground, the remaining part of the external sole being detached from the ground.

7. The sole according to claim 6, wherein when the external sole rests on the ground, and when the footwear is worn bearing the user's weight, the one or more deformable areas are compressed towards the foot of the user, causing substantially all of the external sole to contact the ground.

8. The sole according to claim 1, wherein the extension is integrally made with the external sole or is coupled to the external sole by chemical and/or physical adhesion between the external sole and the one or more pliable areas.

9. The sole according to claim 1, wherein the one or more pliable areas comprise a first part firmly coupled to the external sole, wherein the extension is made of an elastically compressible material integrally made with said first part, wherein the extension is integrally made or coupled by chemical and/or physical adhesion or is mechanically coupled to the external sole, and wherein the foot contacting end portion is configured to project beyond the foot side of the insole and the cleaning insole through at least one or more through slots.

10. The sole according to claim 9, wherein the foot contacting end portion is engaged with the insole at least one passage slot.

11. The sole according to claim 10, wherein, on the side of the insole opposite to the foot, the foot contacting end portion is larger that the at least one passage slot, and wherein the extension has a cross-section substantially equal to said passage slot and extends through the at least one passage slot.

12. The sole according to claim 11, wherein the foot contacting end portion has an enlarged head contacting the foot, and wherein the enlarged head has a plan size greater than the passage slot of the insole and overlaps an edge of said slot on the side of the insole contacting the foot.

13. The sole according to claim 1, wherein the extension is provided in an area corresponding to the heel of a foot, wherein the extension is formed of a tubular structure having peripheral contact with one of the one or more pliable areas, and wherein the extension further includes an end portion structured to be a plug of said tubular structure.

14. The sole according to claim 13, wherein the tubular structure is formed of two hollow and concentric essentially cylindrical elements both in contact with the one or more pliable areas of the external sole.

15. The sole according to claim 1, wherein the one or more pliable areas include a cup-shaped protrusion in the direction of the insole, and wherein an extension member bearing a foot contacting end includes an appendage for coupling inside the cup-shaped protrusion.

16. The sole according to claim 15, wherein the appendage comprises an elastically compressible member.

17. The sole according to claim 15, wherein the appendage has one or more laterally projecting annular bands that are spaced apart axially, and wherein the one or more annular bands are compressible in a direction transverse to the coupling direction.

18. The sole according to claim 15, wherein between the appendage and the cup-shaped protrusion there is provided an elastic member.

19. The sole according to claim 15, wherein the appendage is axially slidable within the cup-shaped protrusion.

20. The sole according to claim 15, wherein the cup-shaped protrusion has an open cross section formed by a slot, and wherein an outer closed annular member is insertable in the slot by forcing on the outside of said protrusion.

21. The sole according to claim 20, wherein the cup-shaped protrusion comprises a rim of axial members equally spaced apart along a closed perimetral line.

22. The sole according to claim 15, wherein the foot contacting end portion includes a plurality of parallel protrusions each intended to engage and to pass through the slot of the insole, and wherein said parallel protrusions are connected one with the other at least at an end by the appendage.

23. The sole according to claim 1, wherein one of the one or more pliable areas is disposed in the area of the foot metatarsus and comprises a plurality of extensions of essentially cylindrical shape extending from the pliable area towards the user's foot.

24. The sole according to claim 23, wherein the extensions of essentially cylindrical shape have a rounded free end faced towards the user's foot.

25. The sole according to claim 23, wherein the extensions of essentially cylindrical shape are in contact one with respect to the other.

26. The sole according to claim 1, wherein the foot contacting end portion comprises an enlarged head in contact with the user's foot that includes adjacent projections of rounded shape.

27. The sole according to claim 23, wherein the plurality of extensions comprise an elastically pliable material.

28. The sole according to claim 26, wherein the adjacent projections comprise an elastically pliable material.

29. The sole according to claim 1, wherein the extension is not integral with the external sole, and wherein the extension engages the external sole with a T-shaped portion faced towards the user's foot with an essentially convex surface.

30. The sole according to claim 29, wherein the external sole comprises a housing for engaging the T-shaped portion.

* * * * *